US006318415B1

(12) United States Patent
Kutzleb et al.

(10) Patent No.: US 6,318,415 B1
(45) **Date of Patent: *Nov. 20, 2001**

(54) QUICK RELEASE COUPLING/PULLEY ASSEMBLY FOR IMPROVED WEAVING DEVICE

(75) Inventors: Chester F. Kutzleb, Sagle; Roger King, Sandpoint; Anders Bostrom, Sandpoint; Robert Kellogg, Sandpoint, all of ID (US)

(73) Assignee: WIS Seaming Equipment Inc., ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/458,308

(22) Filed: Dec. 10, 1999

(51) Int. Cl.[7] ..... D03C 13/00
(52) U.S. Cl. ..... 139/455; 139/59; 139/85
(58) Field of Search ..... 139/59, 85, 455

(56) References Cited

U.S. PATENT DOCUMENTS

| | | | | |
|---|---|---|---|---|
| 3,865,148 | * | 2/1975 | Wolfgang et al. | 139/59 |
| 3,918,500 | * | 11/1975 | Katsumata | 139/59 |
| 4,034,782 | * | 7/1977 | Bucher | 139/85 |
| 5,309,950 | * | 5/1994 | Bassi et al. | 139/88 |
| 5,628,347 | * | 5/1997 | Rush | 139/455 |
| 5,819,813 | * | 10/1998 | Dewispelaere | 139/455 |
| 5,839,481 | * | 11/1998 | Bassi et al. | 139/455 |
| 5,860,454 | * | 1/1999 | Mista et al. | 139/455 |
| 5,911,247 | * | 6/1999 | Waters | 139/455 |
| 6,041,831 | * | 3/2000 | Kuoni et al. | 139/55.1 |
| 6,050,302 | * | 4/2000 | Guse et al. | 139/1 R |
| 6,085,803 | * | 7/2000 | Dewispelaere | 139/455 |
| 6,105,628 | * | 8/2000 | Duhamel | 139/455 |

FOREIGN PATENT DOCUMENTS

| | | | | |
|---|---|---|---|---|
| 421 370 A1 | | 10/1990 | (EP) . | |
| 0292632 | * | 7/1987 | (EP) | D03C/3/44 |

OTHER PUBLICATIONS

Staubli AG brochure; "Name–Weaving Jacquard Machine CX 160"; undated; 6 pages.
Grosse Webereimaschinen GmbH "Electronic High Speed Jacquard–Machine EJP–3"; undated; 4 pages.

* cited by examiner

*Primary Examiner*—John J. Calvert
*Assistant Examiner*—Robert H. Muromoto, Jr.

(57) ABSTRACT

A weaving device is described, having a frame, an eyelet and a module releasably borne by the frame to selectively transmit a motive force to the eyelet. A coupling includes first and second members which are releasably coupled together in force receiving relation and relative to the module. The first member is connected to the eyelet, and the second member is connected to the module. The coupling transmits motive force from the module to the eyelet to move the eyelet selectively relative to the frame. The coupling facilitates removal and replacement of the module from the frame.

52 Claims, 6 Drawing Sheets

QUICK RELEASE COUPLING/PULLEY ASSEMBLY FOR IMPROVED WEAVING DEVICE

TECHNICAL FIELD

The present invention relates generally to weaving devices and more particularly to quick release couplings therein.

BACKGROUND OF THE INVENTION

Weaving devices, commonly called looms, are known in the art and have been in existence in one or another form for thousands of years. Weaving devices are generally used for producing woven fabric. Generally speaking, weaving devices consist of a frame, a substantially horizontal array of eyelets movably supported by the frame between an upper position and a lower position, and a mechanism for moving the eyelets between the two positions.

To set up a typical weaving device for operation, a thread, or any type of weavable strand, is drawn off a spool and passed through an eyelet of the weaving device, then passed through a guide which is on the opposite side of the eyelet from the spool. The guide may be in the form of a long horizontal slot, or a gap between two horizontal, vertically opposed rollers for example. Each eyelet is threaded in this manner with an individual thread.

Selected eyelets are oriented in the upper position and slightly above the guide, while the remaining eyelets are oriented in the lower position and slightly below the guide. This difference in the relative positions of the eyelets with respect to each other and to the guide, causes the threads to form an upper and lower row of parallel threads. The upper row passes from the upper eyelets to the guide, and the lower row passes from the lower eyelets to the guide. The two rows intersect, or meet, at the guide to form an acute interior corner or angle. This formation of two rows of threads is generally called a shed. Thus, a shed can basically be described as two flat planes, each formed by a row of parallel threads, which meet to form a trough, or corner.

To begin the weaving process a cross-thread, called a weft thread, is placed into the corner of the shed where the threads meet at the guide, and perpendicular to the warp threads. After placement of the weft thread, the position of each eyelet is reversed, that is, the upper eyelets move to the lower position, and the lower eyelets move to the upper position. This change in position of the eyelets not only forms another shed, but also causes the warp threads to partially wrap around the weft thread. A second weft thread is then inserted into the corner of the new shed, and the position of each eyelet is again reversed. This process is continually repeated to form a fabric created from interlacing, or weaving, the warp and weft threads.

Basic woven fabric is produced on weaving devices which move the respective eyelets in a continuously repeating sequence of shed changes to produce a substantially homogeneous fabric pattern. However, a special type of weaving device, called a Jacquard device, may be used, for among other purposes, to weave intricate or varying patterns in to the fabric, or to perform seaming operations in which the opposite edges of a piece of fabric are woven together to form an endless ribbon or belt of fabric. Jacquard devices are well known in the art and have been in existence for hundreds of years in various forms. In a Jacquard device, each eyelet is individually selectively movable with respect to each of the shed changes. In other words, the sequence of movements of the eyelets is not merely uniformly repetitive, but may be selectively variable with each shed change. In this manner, varying and stylistically appealing patterns may be woven into the fabric by the weaving device.

Generally speaking, a Jacquard weaving device consists of an array of sprines mounted on the top of the frame of the weaving device. An eyelet is attached to each of the springs and depends from the lower end of the spring. The respective springs bias the eyelets toward an upper position. A pulley block is attached to the lower side of each eyelet and depends below the eyelet. A cord is fed or otherwise received through the pulley block and engages the sheave, or pulley wheel of same. The opposite ends of the cord depend from the pulley block. The cord has two hooks attached to it, one on each end.

Attached to the frame, are griff bars which reciprocally move up and down below the pulley block. The griff bars are mechanically linked together so that, as one griff bar moves up, the other correspondingly moves down, and vice versa. An actuator such as an electrical motor is coupled to one of the griff bars to reciprocally move the griff bars at continuously selective and repeating intervals.

The hooks slidably engage guides which are mounted on the frame. The respective guides restrict and direct the path of movement of the hooks such that the path of movement of one of the hooks substantially coincides with one of the griff bars, and the path of movement of the other hook substantially coincides with the other griff bar. Each hook has a slot formed therein which is engaged by the respective griff bar as it moves downwardly. If the hook is held in its lowermost position, the slot formed on the hook allows the griff bar to disengage from the hook and move upwardly while leaving the hook in its lower position.

The cord which extends between the respective hooks is of such a length that the individual springs, located above each of the eyelets, keeps the cord taut at all times. When both hooks are engaged by the respective griff bars, the hooks and cord travel in a seemingly see-saw like motion along with the griff bars. During this motion the cord is pulled back and forth through the pulley block and rollingly engages the sheave. Also during this pattern of motion, the pulley block and eyelet remain substantially stationary (in the upper position) being held in the same position by the tension of the spring.

In these weaving devices the lower end of each hook is engageable by means of a latch which is mounted on the frame and which is located near the bottom of the path of travel of each of the hooks. Each latch selectively captures and retains the respective hook in the lower position. If one of the hooks is held in its lower position by the respective latch, the associated griff bar disengages from the hook as it travels upwardly, leaving the hook retained by the latch in the lower position. As the griff bar moves upwardly, leaving the associated hook retained by the latch, the other hook (attached to the opposite end of the cord) is simultaneously pulled downwardly toward another latch by the other griff bar. Because the first hook is latched in the lower position, and is not allowed to travel upwardly while the other hook is being pulled downwardly, the pulley block is simultaneously pulled downwardly by the cord attached between the hooks. This action, of course, pulls the eyelet downwardly against the upwardly biasing, force of the spring attached to same. This results in the eyelet reaching a lowermost position as both hooks reach their as respective lowermost positions.

For the eyelet to remain in the lower position, both the first and second hooks must be retained in their respective lowermost positions by their respective latches. In this manner, the individual griff bars continue to reciprocally move in a see-saw like motion above both hooks, but do not cause movement of the hooks, cord, pulley block, or eyelet. Conversely, for the eyelet to move to its upper position once again, one of the latches must disengage from one of the hooks as the associated griff bar is located in the lowermost position. In this manner, one of the hooks is released by the latch and allowed to travel upwardly with the griff bar to its upper position under the influence of the spring. This action results in the respective pulley block and eyelet moving upwardly to the original upper position. For the eyelet to remain in the upper position, the other latch must also release its respective hook, allowing the see-saw like motion of the hooks and cord to resume as initially described.

Many Jacquard weaving devices utilize electric solenoids to effect the selective retention of the hooks by the latches. In this type of design, an electric solenoid is mounted on the frame near each of the respective latches. Mounted on each latch is a material which can be magnetically influenced, or attracted, such as iron, when the solenoid is energized with electrical current. Generally, each latch is biased into a first, or latched, position. During operation, as a hook is moved into engagement with the respective latch, the hook pushes the latch into a second, or unlatched position, and in the direction of the solenoid such that the magnetically attractable material is pressed against or moved closely adjacent to the solenoid. In the situation where the solenoid is energized, the material is strongly attracted to the solenoid by the magnetic field. This in turn holds the latch in the unlatched position which prevents the latch from capturing and retaining the hook in the lowermost position as the hook moves upwardly and away from the respective latch.

On the other hand, if the solenoid is not energized, the bias of the latch causes the latch to move back to the latched position as the hook begins to move upwardly. In this scenario, before the hook completely disengages from the latch, the latch captures the hook, thereby retaining it in the lowermost position. If the hook is retained by the latch, the griff bar will disengage from the hook and continue moving upwardly while leaving the hook in its lowermost position. However, the subsequent downward movement of the griff bar will again move the hook against the respective latch in a manner which will cause movement of the latch to the unlatched position. This enables the hook to be subsequently released from the latch if the latch had been held in the unlatched position by the solenoid. In this manner, the weaving device selectively moves the eyelet by energizing and de-energizing the solenoids at given intervals which controls the movement of the hooks. Often a controller, such as a programmable logic computer, is utilized to control electrical current flow to the solenoids and related motor which propels the individual griff bars.

Commonly, a Jacquard weaving device consists of at least one row of eyelets which are configured as discussed above, with respective springs, pulley blocks, cords, hooks, latches and solenoids for each eyelet. Usually, the entire row of eyelets is served by a single pair of elongated griff bars. In this manner, each individual eyelet in the row may be moved from either the upper position to the lower position, or vice versa, or may remain in either the upper or lower position with each reciprocal stroke of the griff bars. Often, large Jacquard weaving devices consist of several such rows of similarly configured eyelets, each with its own set of griff bars. Thus, by moving the griff bars at repeating intervals, and selectively controlling the activation of the solenoids, the controller can cause any combination of eyelets to either move up or down, or remain in the upper or lower positions, with each shed change.

While Jacquard weaving machines of conventional design have been operated with varying degrees of success, there have been recognized shortcomings which have detracted from their usefulness. For example, a relatively large Jacquard weaving machine may consist of a dozen or more rows of eyelets, each row having up to thirty or more eyelets. Such a machine, having hundreds of individually movable eyelets, will have a complex, tightly packed mechanism comprised of interactive, precision components, including griff bars and related drive trains, hooks, latches, solenoids, cords, guides, and pulley blocks. Thus, a malfunction or failure of a single component in this complex, tightly packed mechanism necessitates a tedious and time-consuming disassembly of the machine in order to simply gain access to the failed or malfunctioning part for removal and replacement. This tedious disassembly process of the machine results in costly down-time of the weaving device, during which the operation of the device is temporarily halted.

Therefore, it has long been known that it would be desirable to provide a Jacquard weaving machine which achieves the benefits to be derived from similar prior art devices, but which avoids the detriments individually associated therefrom.

SUMMARY AND OBJECTIVES

According to one aspect the present weaving device includes a frame and an eyelet movably mounted on the frame and a module releasably borne by the frame is operable to selectively transmit a motive force to the eyelet. The weaving, device further comprises a coupling, having a first and second member which are releasably coupled together in force receiving relation and relative to the module. The first member is mounted on the eyelet, and the second member is mounted on the module. The coupling transmits motive force from the module to the eyelet to move the eyelet selectively relative to the frame. The coupling facilitates removal and replacement of the module.

Another aspect of the present invention relates to a weaving device having a frame, a resilient member mounted on the frame, an eyelet mounted on the resilient member and movable with respect to the frame, and a first cord mounted on the eyelet. In this aspect, the weaving device includes a module releasably borne by the frame and operable to selectively transmit a motive force to the eyelet. A second cord is mounted on the module. A coupling is included, having a first and second member releasably fastened together. The first member is operably engaged by the first cord, and the second member is operably engaged by the second cord. The coupling coacts with the first and second cords to transmit motive force from the module to the eyelet to effect movement of the eyelet relative to the frame. Detachment of the first and second members facilitates removal and replacement of the module.

In a still further aspect, the present invention relates to a weaving device having a frame. A resilient member is mounted on the frame, and an eyelet is mounted on the resilient member which is movable with respect to the frame. A first cord having a first end is fixedly mounted on the frame and a second end is mounted on the eyelet and movable therewith. The weaving device includes a module releasably borne by the frame. A griff bar is mounted on the module and is reciprocates along a path of travel in relation thereto. A latch is pivotally borne by the module, along with a solenoid which is disposed in coactive relation to the latch, and operable to influence the positional disposition of the latch by the production of a magnetic field when energized. A hook is movably borne by the module and is selectively engageable by the latch and griff bar, and which coacts with same so as to be selectively movable along the path of travel of the griff bar.

A second cord has a first end which is fixedly mounted on the module, and a second end which is mounted on the hook and movable therewith. A coupling has a first and second member which are releasably fastened together, and wherein the first member has a sheave rotatably mounted thereon which is operably engaged with the first cord between the first and second ends thereof, and which coacts therewith to affect movement of the eyelet. The second member has a sheave rotatably mounted thereon and which is operably engaged with the second cord between the first and second ends thereof.

The first member has a male fastening portion, and the second member has a complimentary female fastening portion which receives the male fastening portion in releasable interlocking relation therewith. A tool is selectively engageable with the coupling to detach the first and second members.

In a yet further aspect of the present invention, a coupling and associated tool are combined for use with a weaving device which has a frame, an eyelet movably mounted on the frame, and a motor which selectively produces a motive force which acts upon the eyelet. The coupling and related tool include a first member which is mounted in force transmitting relation relative to the eyelet. The first member has a main body with opposite first and second ends, and wherein the main body defines an internal cavity. An aperture is formed in the first end of the main body and communicates with the cavity. A sheave is rotatably mounted in the cavity, and a pair of resiliently deflectable arms are disposed on the second end of the main body.

Each of the deflectable arms has a proximal end which is made integral with the second end of the main body, and an opposite distal end. The respective deflectable arms move along a given path of travel between a locked position and an unlocked position.

A space is defined between the respective deflectable arms and the second end of the main body. A second member is releasably coupled to the first member and has a main body with opposite first and second ends. The second end is disposed in force receiving relation relative to the motive force.

The main body defines first and second cavities, and first and second apertures are defined by the first and second ends of the main body which communicate with the respective first and second cavities. The first cavity is located adjacent to the first end of the main body and the second cavity is located adjacent to the second end of the main body.

A tool-receiving aperture is formed in the main body and is located intermediate the first and second ends of the main body and which further communicates with the first cavity. A sheave is rotatably mounted in the second cavity. A locking member is mounted in the first cavity. The first and second members are releasably coupled together and the respective deflectable arms are received in the first cavity of the second member and are disposed in releasable interlocking relation relative to the locking member and partially occlude the tool-receiving aperture.

A tool is provided to be received in the tool-receiving aperture. The tool facilitates engagement and disengagement of the first and second members. The tool, when received in the tool-receiving aperture, disengages the respective deflectable arms from the locking member.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
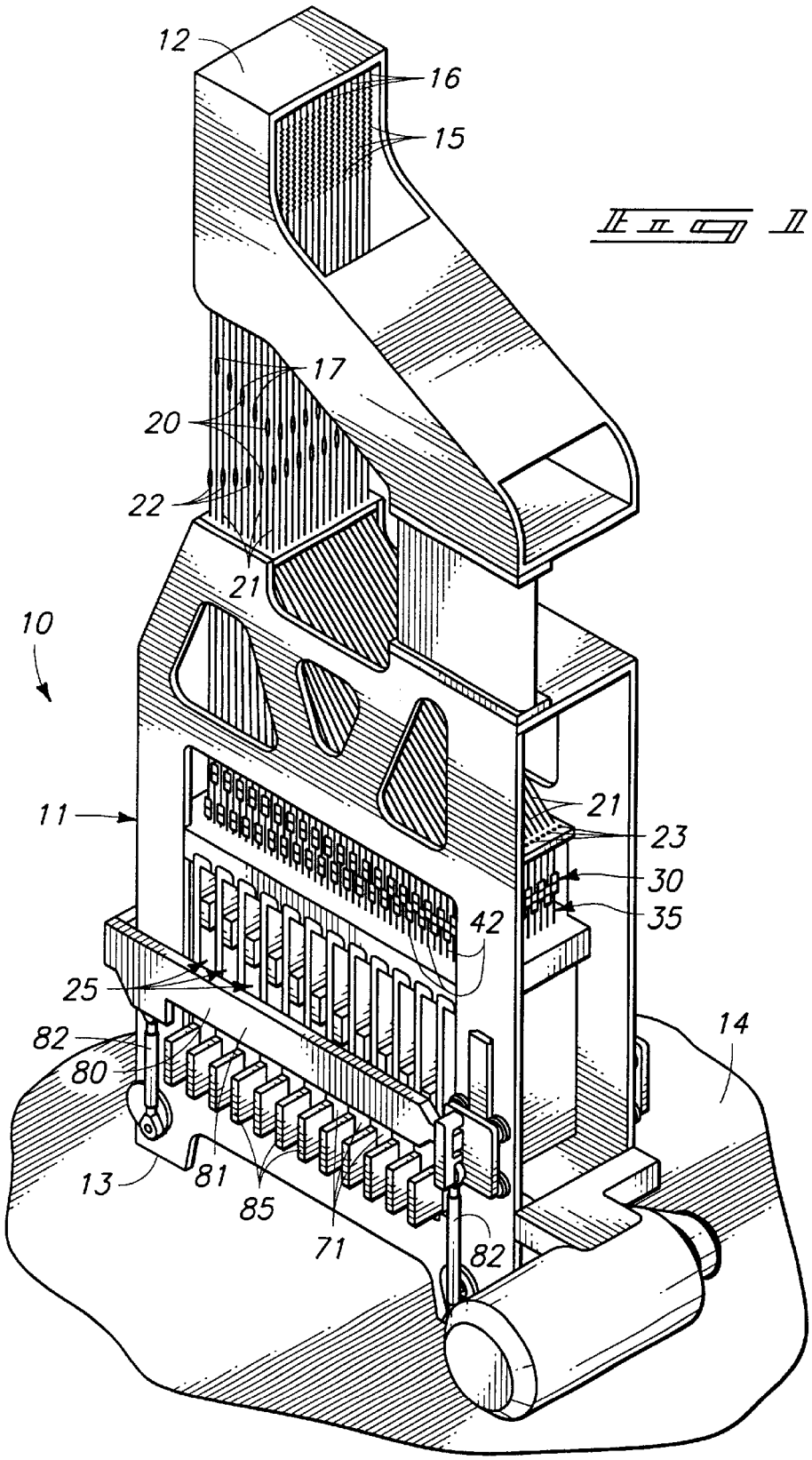
FIG. 1 is a perspective view of a weaving device incorporating aspects of the present invention.

A preferred apparatus incorporating aspects of the subject invention is generally indicated by the numeral 10 in the accompanying drawings. As shown in FIG. 1, the apparatus 10 may be provided in combination with a weaving device frame 11 which has a first end 12 and an opposite second end 13. The weaving device frame 11 rests directly or indirectly on the surface of the earth 14.

Figure 3:
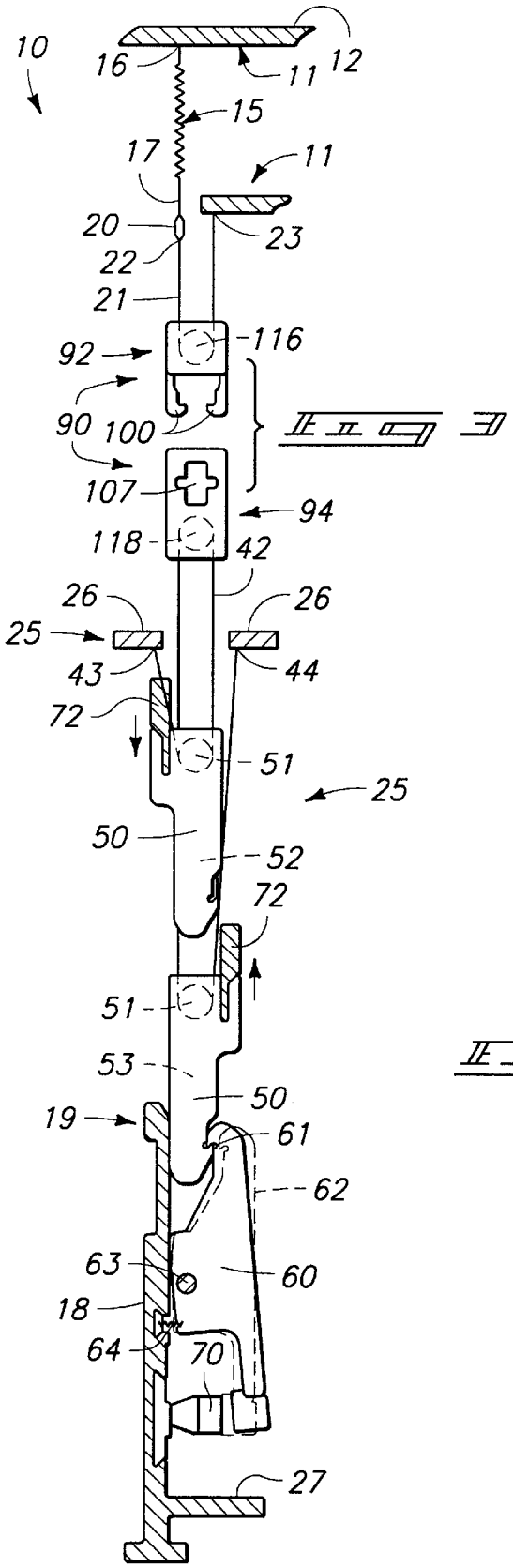
FIG. 3 is a schematic view illustrating interconnection of first and second cord members within the weaving device.

As can be seen in FIG. 1 and by schematic in FIG. 3 a plurality of biasing members 15 each having a first end 16 and a second end 17 are individually mounted on the first end 12 of the weaving device frame 11. As also seen in FIG. 1 an eyelet 20 is individually mounted on the second end 17 of each biasing member 15, and is movable with respect to the weaving device frame 11. Each of the eyelets 20 is biased by a respective biasing member 15 in the direction of the first end 12 of the weaving device frame 11.

Figure 2:
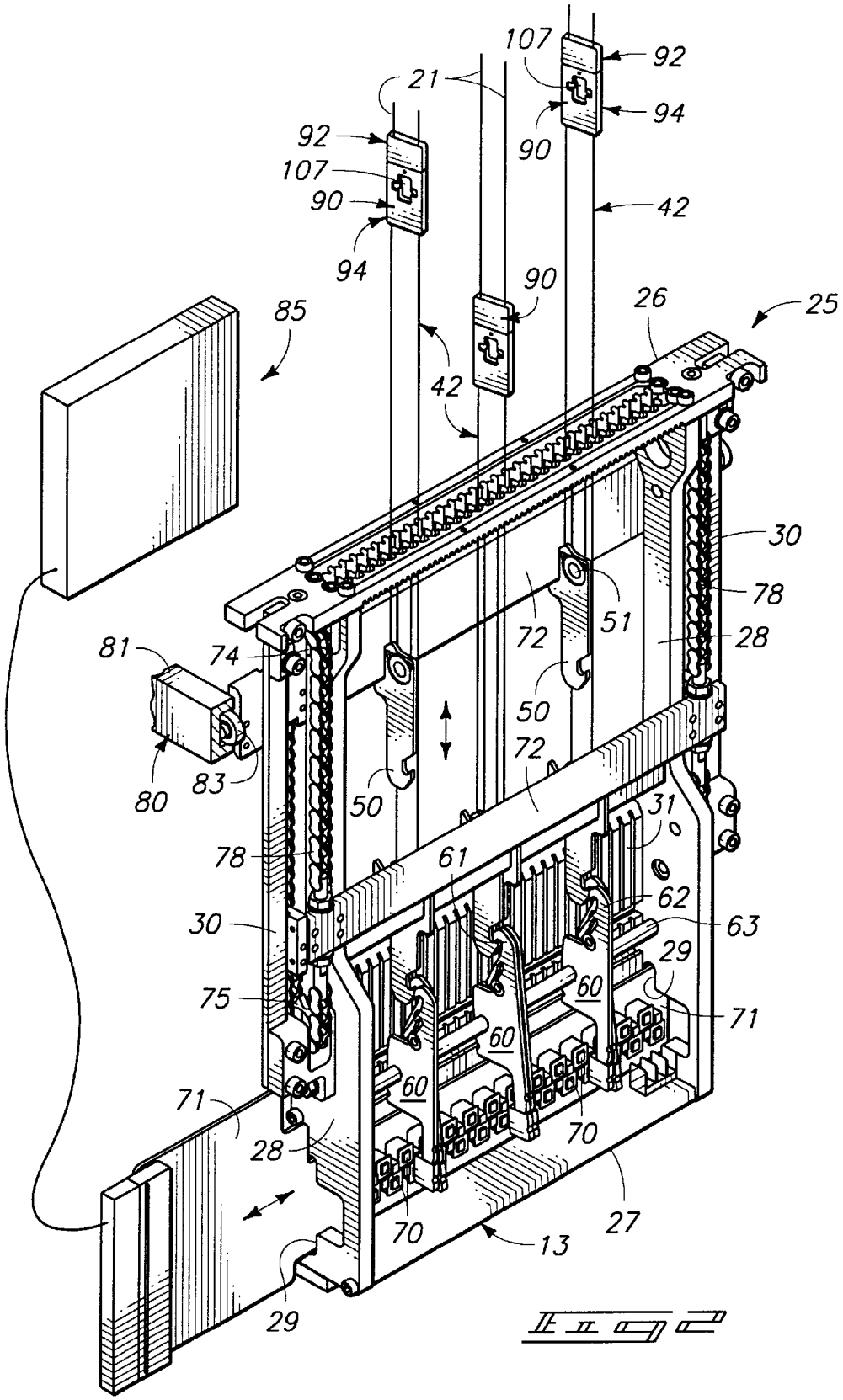
FIG. 2 is an enlarged perspective view of a frame module removed from the weaving device.

As also shown by FIGS. 1, 2, and the FIG. 3 schematic, the apparatus 10 includes a plurality of first cords 21 each having a first end 22 and an opposite second end 23. The first end 22 of each first cord 21 is affixed to an eyelet 20, and the opposite second end 23 is connected to the weaving device frame 11.

Now referring to FIG. 1 and more particularly to FIG. 2, a frame module 25 is detachably mounted on the weaving device frame 11. In selected forms, as exemplified by FIG. 1, several similar or identical modules 25 may be supplied in substantially juxtaposed relation on the weaving device frame.

Referring to FIG. 2, a preferred frame module construction includes a rigid frame formed with a first end 26 and an opposite second end 27, and a pair of spaced sidewalls generally indicated by the numeral 28. A channel 29 is formed in at least one of the sidewalls 28 adjacent to the second end 27 of the frame module 25 for releasably receiving a solenoid 70 and in the illustrated embodiment, a plurality of solenoids, mounted to a substrate 71.

A pair of griff tracks indicated by the numeral 30 are provided on each of the frame modules 25, preferably along the spaced sidewalls 28. In preferred forms, a guide plate 31 is also mounted within each module between the respective sidewalls 28 for the purpose of guiding movement of hook and latch assemblies that are mounted within the individual modules to control positioning of the eyelets 20.

A plurality of hooks 50 are mounted within and are selectively movable relative to the respective frame modules 25 as determined by the guide plates 31. Each of the hooks 50 preferably mounts a rotatable pulley wheel 51. As further shown in FIGS. 2 and 3, the pulley wheel 51 of each hook 50 is engaged by a second cord 42 that extends between first and second cord ends 43 and 44. Each of the hooks 50 is selectively movable between a first position 52 situated toward the first module frame end 26, and a second position 53 situated toward the second module frame end 27.

A plurality of latches 60 are movably mounted on a pivot shaft 63 that extends between the side walls 28. Each latch 60 is movable between a latched and an unlatched position 61, 62. Each latch 60 is biased toward the latched position 61, preferably by a resilient member 64. In the forms illustrated, the latches 60 pivot on the shaft 63 between the latched and unlatched positions.

Each of the hooks 50 is movable to selectively engage an associated latch 60 and be retained by the latch when the hook 50 is located in the second position 53, and the latch 60 is located in the latched position 62.

As briefly noted above, the apparatus 10 also includes a plurality of solenoids 70, one for each module 25, which are mounted on supporting substrate 71. As shown in FIG. 2, the supporting substrate 71 is slidably engageable within respective channel 29 which are formed through the sidewall 28 of the associated frame module 25. The solenoids 70 each have an energized and a de-energized state, and facilitate the movement of the respective latches 60 between the latched positions 61 and the unlatched positions 62.

A given solenoid 70 in the de-energized state does not maintain the respective latch 60 in the unlatched position and the respective hook 50 upon engaging the latch 60, causes the latch 60 to engage and retain the respective hook 50 in the second position 53. Conversely, a given solenoid 70 in the energized state maintains the respective latch 60 in the unlatched position 62 wherein the respective hook 50 is not retained in the second position 53. This facilitates shed changes by enabling alternate changing of the eyelet position.

Figure 4:
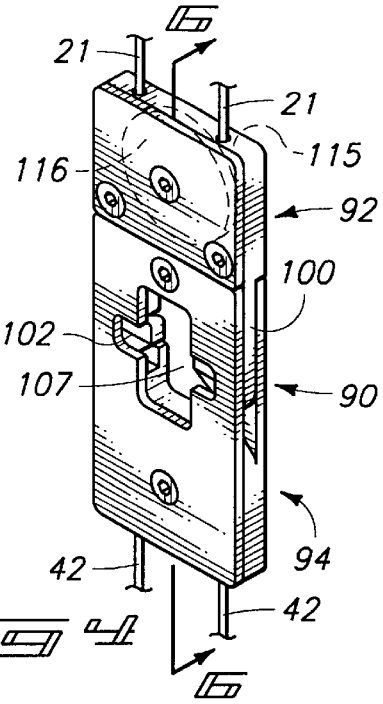
FIG. 4 is an enlarged perspective view of a single preferred quick release coupling in a closed, interconnected condition.
Figure 5:
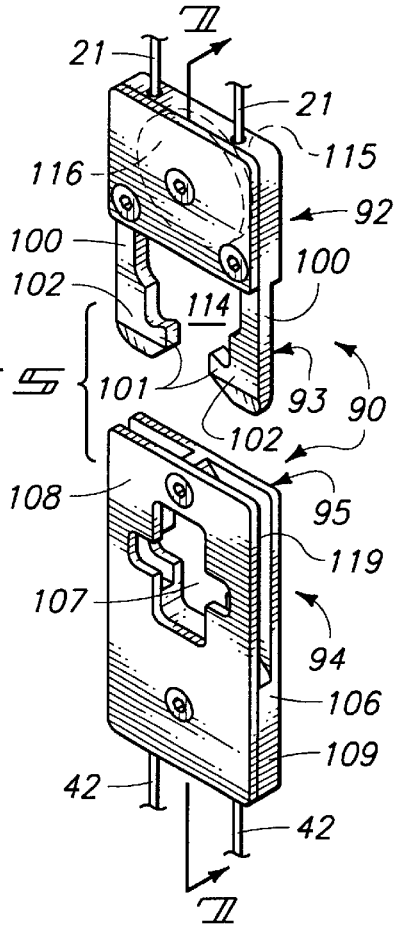
FIG. 5 is a view similar to FIG. 4 only showing first and second coupling members of the coupling in a disconnected condition.

Referring to FIG. 2 and the simplified diagram of FIG. 4, the apparatus 10 further includes a pair of griff bars 72 which are each selectively movably borne on each frame module 25. Each griff bar 72 is slidable along the associated griff tracks 30 in a reciprocal path of movement. As shown in FIG. 2, each griff bar 72 is selectively engageable with a predetermined number of the hooks 50, and when engaged with the hooks 50 the griff bar 72 reciprocally moves those hooks 50 (which are not held by the respective latches 60), from the second hook positions, to the first hook positions.

FIG. 2 further indicates first and second pairs of wheels that are provided preferably in the form of sprockets 74, 75 respectively, which are rotatably mounted on one of each of the opposite sidewalls 28 of the frame module 25. The first and second pairs of sprockets 74, 75 are rotatable about rotational axes which are substantially perpendicular to the sidewalls 28 of the respective frame modules 25.

Referring to FIG. 2, a drive member 78 in the form of a chain is disposed in forced transmitting relation between each respective first and second pairs of sprockets 74, 75, and the pair of griff bars 72. The configuration of the drive member 78 and the first and second pairs of sprockets 74 and 75 in relation to the griff bars 72 is such that the direction of movement of one griff bar 72 is opposite to the direction of movement of the other griff bar 72 of a pair.

As shown in FIG. 1, a preferred apparatus 10 further includes an actuator 80 which is releasably disposed in force transmitting relation to one of each pair of griff bars 72, and which transmits motive force to the griff bars 72.

In preferred forms, the actuator 80 is comprised of a bar 81 that is operated by a bellcrank linkage 82 on the weaving device frame 11, and which is driven by a motor 84. The linkage 82 is connected to ends of the bar 81 to move the bar as the motor operates, in a selected rocking motion. Amplitude of the motion is adjustable by varying the lengths of the linkage members.

The actuator 80 is slotted longitudinally to receive rollers 83 that are mounted to one griff bar 72 of each griff bar pair. Motion of the bar 81 is thus transmitted to the rollers 83 which, in response, cause the griff bars 72 to move a reciprocating translational path. The griff bars contact and move selected hooks to engage or disengage selected latches to produce shed changes by alternately shifting the eyelets 20 which are connected through cords 21 and 42 to the hooks 50.

FIG. 2 indicates a controller 85 releasably electrically coupled to each of the solenoids 70, and which selectively energizes each of the individual solenoids 70 to magnetically hold selected latches in the latching positions, depending upon desired shed formations. A controller 85 may be provided for each of the frame modules supplied in a weaving device.

The above components which are mounted to the various modules 25 may be easily and quickly removed from the weaving device frame 11 by provision of the present quick release coupling arrangement, preferred configurations of which are designated by numeral 90 and illustrated in FIGS. 4–10.

The quick release coupling arrangement 90 enables driving connection between the hooks 50 and the eyelets 20 such that movement of the various hooks will effect corresponding movement of the associated eyelets 20. There is a single coupling arrangement 90 for each one of the eyelets 20. The quick release arrangements 90 may be similar if not identical to one another so description of one will suffice for a description of all.

In general, the quick release coupling 90 includes first and second members 92, 94 which are releasably coupled together in force receiving relation and relative to the module 25. In general, the first member is connected to an eyelet 20, and the second member 94 is connected to the associated module 25. The coupling transmits the motive force from the module to the associated eyelet 20 to move the eyelet selectively relative to the weaving device frame 11. The coupling also facilitates removal and replacement of the associated module 25.

The first member has a male portion 93, and the second member has a complimentary female portion 95 which receives the male portion 93 in releasable coupling relation. The complimentary portions 93, 95 are preferably made integral with the respective first and second members 92, 94 and engage each other (FIG. 4) to releasably couple the first and second members together.

The male portion 93 includes a main body 96, with a first end 98 and a second end 99. An elongated member, such as a resiliently deflectable arm 100 is situated at the second end, having an enlarged end portion 102.

The female portion 95 includes a complimentary locking member 104 (FIG. 7) which releasably mates with and retains the arm 100 by the enlarged end portion 102 thereof. The enlarged end portion 102 resiliently deflects (FIG. 9) when moved into engagement with the locking member 104 to effect a snap-fit engagement of the enlarged end portion by the locking member 104.

In more specific embodiments, a pair of the resiliently deflectable prongs or arms 100 extend outwardly from the body of the first member and define the space 114 therebetween. Each of the deflectable arms 100 has a proximal end 112, and wherein each proximal end 112 includes the enlarged portion 102. Distal ends 113 of the arms 100 are integral with the main body 96. The space 114 is defined between the arms 100.

The arms 100 are substantially of equal lengths and are disposed in substantially parallel, spaced, juxtaposed relation relative to each other across the space 114. Each arm 100 also has a laterally disposed inwardly facing and hook-shaped terminus 101, and wherein each hook-shaped terminus 101 faces the other, with the space 114 defined therebetween.

The second member 94 has a main body 106 which defines an aperture 107. The body 106 extends between first and second ends 108, 109. The first end 108 is open to releasably receive the arms 100, and the second end 109 mounts a second sheave 118.

A tool 110 is selectively manually engageable with the coupling 90, and is received in mating relation in the aperture 107. The tool 110, once received in the aperture 107, coacts with the first member 92 and facilitates uncoupling of the first and second members 92, 94. More specifically, the tool 110 coacts with the coupling to releasably deflect the male portion 93 so as to effect disengagement of the male and female portions 93, 94.

The first member 92 defines a cavity or chamber 115 at the first end 98 which mounts a first rotatable sheave 116. An aperture 103 is formed at the first end 98 to guide the first cord 21. The first sheave 116 is rotatably mounted on the first member 92 within the chamber 115 and coacts with the first cord 21. The first member 92 is thus mounted in force transmitting relation to the eyelet by way of the first cord 21. The cord 21 extends downwardly from the first end 22, under the sheave 116, then back upwardly to the second end which is secured to the weaving device frame 11.

The deflectable arms 100 are substantially coplanar with the first sheave 116. This allows for the coupling to present a narrow thickness profile.

The second sheave 118 is rotatably mounted on the second member 94 and operably engages the second cord 42 between respective cord ends 43 and 44. The second sheave 118 is disposed in force transmitting relation relative to associated hooks 50 by the second cord 42.

The first and second members, when coupled, position the deflectable arms 100 and first sheave 116 in substantially coplanar relation relative to the second sheave 118. This further enables a narrow overall thickness dimension for the coupling 90.

The second member 94 also defines a chamber 119 which receives the deflectable arms 100. A diverging engagement surface 120, defined by the locking member 104, is mounted in the chamber 119 which is operable to deflect the deflectable arms 100 and interlock therewith. The deflectable arms 100, when engaged with the engagement surface 120 of the female portion 95, partially occlude the aperture 107.

Figure 6:
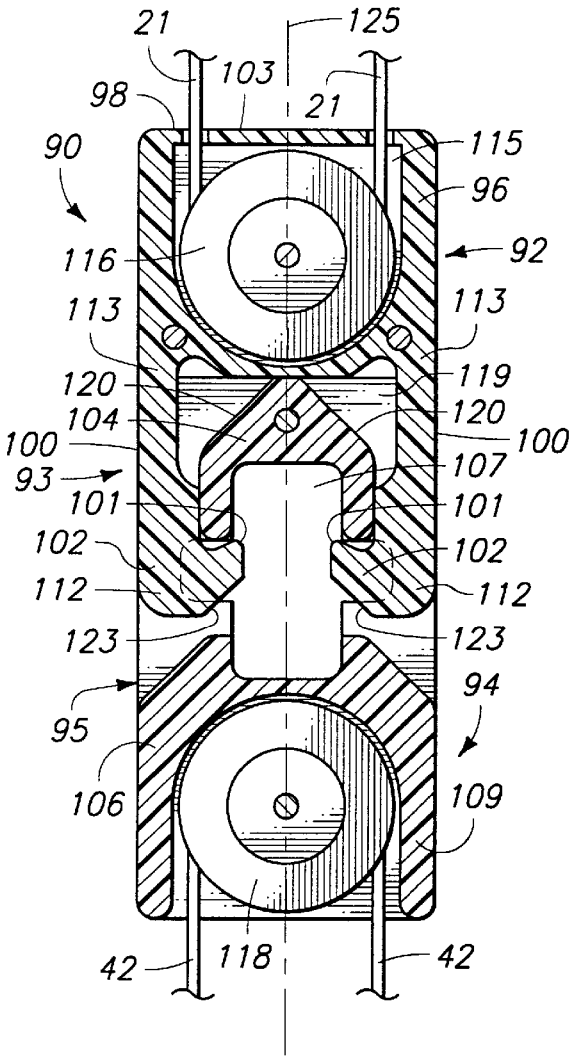
FIG. 6 is a sectioned elevation view taken along line 6—6 in FIG. 4.
Figure 7:
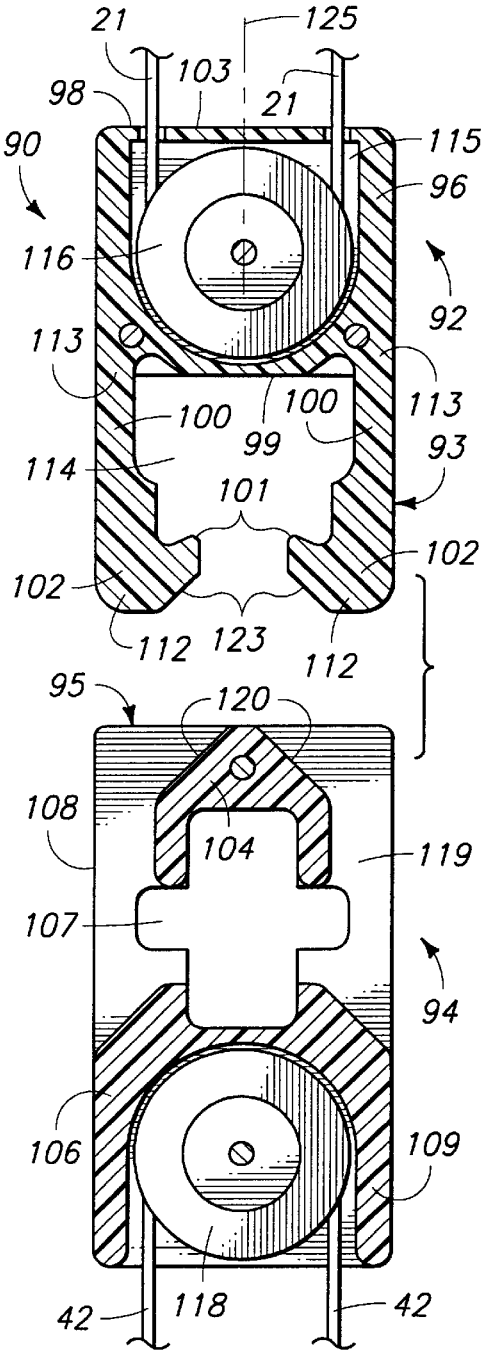
FIG. 7 is a sectioned elevation view taken along line 7—7 in FIG. 5.

The deflectable arms deflect as they engage the diverging engagement surface 120 of locking member 104. When fully engaged with the locking member 104 the deflectable arms 100 return to a substantially undeflected condition, substantially as shown by FIG. 6.

The locking member 104 of the female portion has a proximal end which is adjacent to the first end 108 of the second member, and the distal end which is adjacent to the tool-receiving aperture 107. The locking member includes oppositely diverging sides of the divergent surface 120 that lead from the proximal end to distal ends.

The respective arms 100 resiliently deflect outwardly away from one another to enlarge the gap between them (FIG. 9) as the arms 100 forcefully engage the diverging sides 105. Continued movement of the arms against the diverging sides causes the terminus 101 of each arm 100 to proceed past the distal ends of the locking member 104 and effect a snap-fit with the locking member. Each terminus 101 then in partially occludes the aperture 107.

The distal end of each deflectable arm 100 has an engagement surface 123 thereon which is obliquely oriented relative to a line of reference 125 which passes through the center axes of the sheaves 116 and 118. The engagement surfaces 123 coact with the locking member 104, which lies along and is substantially symmetrical about the line of reference 125. The engagement surfaces 123 releasably interlock with the locking member when the locking member 104 is disposed within the space defined between the respective arms 100, and the deflectable arms are in the locked position.

More specifically, the divergent sides 120 of the locking member 104 function as engagement surfaces which coact with the deflectable arms to deflect to the unlocked position during the engagement of the first member 92 with the second member 94.

Figure 8:
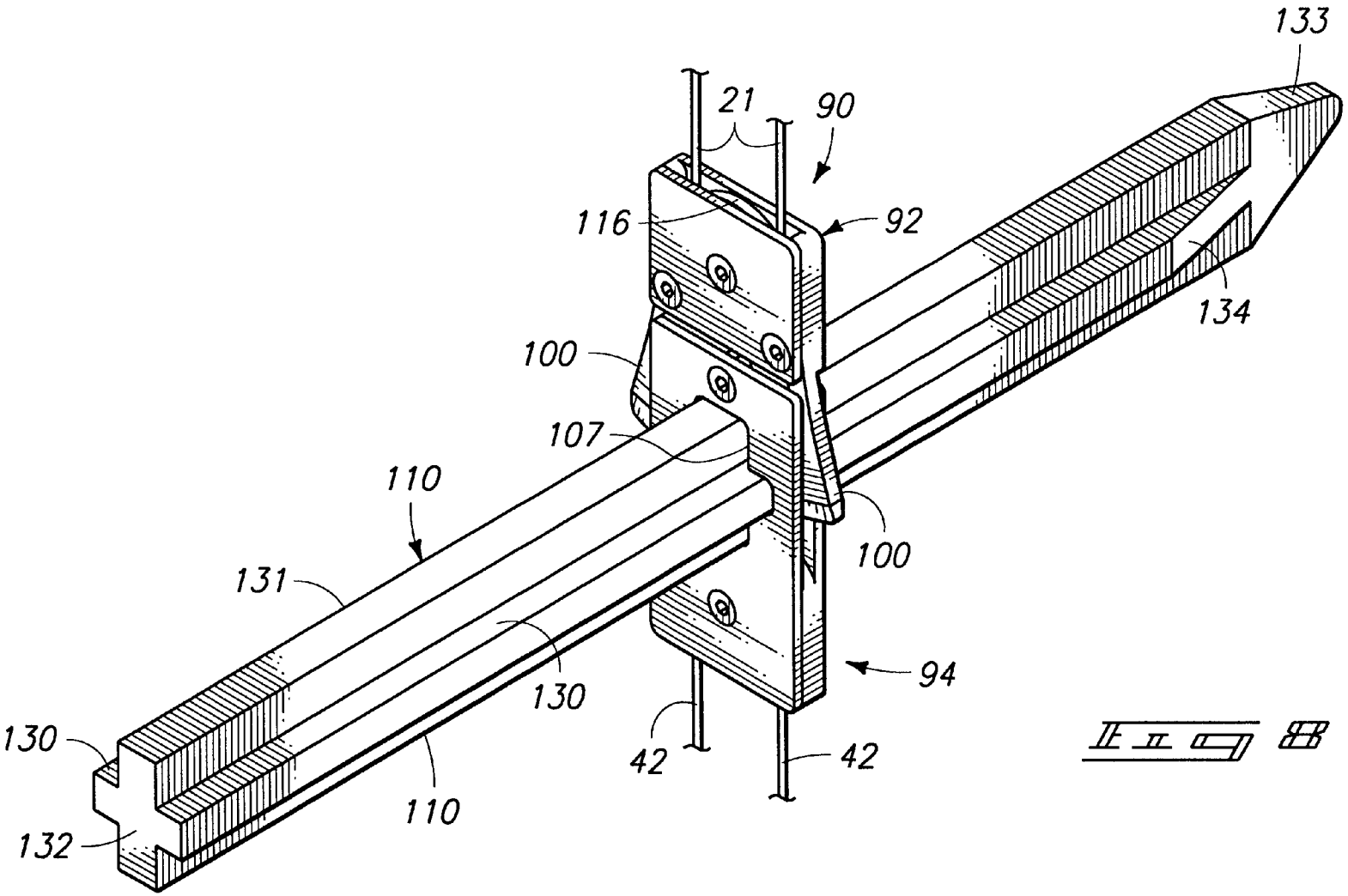
FIG. 8 is a perspective view of a tool used to selectively disengage the first and second coupling members.
Figure 9:
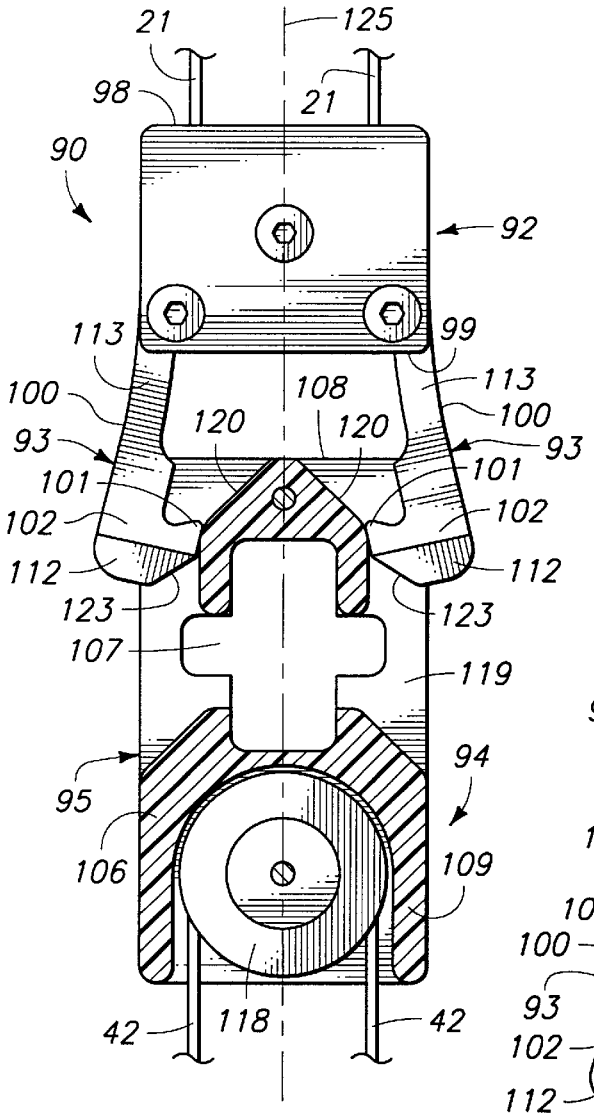
FIG. 9 is a sectioned elevation view illustrating the first and second coupling members in an intermediate position as they are moved together.
Figure 10:
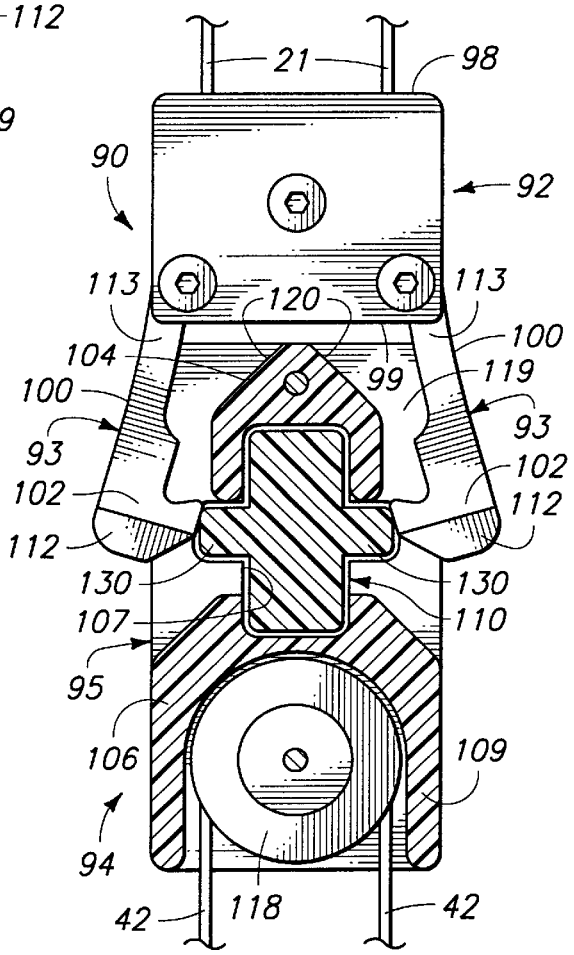
FIG. 10 is a sectioned elevation view illustrating operation of the tool to disengage the first and second coupling members.

Referring in greater detail to the tool 110, attention is directed to FIGS. 8 and 10. The tool 110 is shaped so as to be inserted through the aperture 107 and to engage each exposed terminus 101 and resiliently deflect the same outwardly with respect to the locking member 104 to cause the release of the first member 92 from the second member 94.

As shown, the preferred tool 110, during mating receipt of the tool in the tool-receiving aperture, displaces the deflectable arms from the aperture and moves them to the unlocked position, allowing release of the first and second members. To accomplish this, the tool includes a pair of opposed flutes 130 which individually engage the respective deflectable arms 100 which at present partially occlude the tool receiving aperture.

The tool has an elongated main body 131 with a proximal end 132 and distal end 133, and wherein the flutes 130 extend along the main body 131. The distal end 133 has a reduced cross-sectional dimension relative to the remaining portion of the main body 131. In preferred forms, the flutes 130 converge at the distal end 133, forming cam surfaces 134 that facilitate insertion of the tool 110 into the aperture 107. As the tool 110 is inserted through the coupling 90, the cam surfaces 134 come into sliding contact with the enlarged portions 102 of the arms 100 which are partially occluding the aperture. The cam surfaces 134 force the arms 100 to spread, then hold the arms 100 in outwardly deflected positions (FIG. 10), disengaged from the locking member 104. This allows the first and second members 92, 94 to be separated. The first member 92 will stay with the weaving device frame 11 and the second member will stay with the module 25. The frame module 25 can now be easily removed from the weaving device frame.

It is pointed out that all of the individual couplings on a module 25 may be aligned, and the tool can be inserted through all the aligned apertures 107 to enable simultaneous disconnection of the male members from the associated female members.

Operation

The operation of the described embodiments of the present are believed to be readily apparent and briefly summarized at this point.

One aspect of the present invention includes a weaving device 10 having a frame 11 and an eyelet 20 movably mounted on the frame 11, the weaving device comprising; a module 25 releasably borne by the frame 11 and operable to selectively transmit a motive force to the eyelet 20; a coupling 90 having a first and second member 92, 94 which are releasably coupled together in force receiving relation and relative to the module 25, and wherein the first member 92 is mounted on the eyelet 20, and the second member 94 is mounted on the module 25, and wherein the coupling 90 transmits the motive force from the module 25 to the eyelet 20 to move the eyelet 20 selectively relative to the frame 11, and wherein the coupling 90 facilitates removal and replacement of the module 25.

Another aspect includes, a weaving device 10 having a frame 11, a biasing member 15 mounted on the frame, an eyelet 20 mounted to the resilient member 15 and movable with respect to the frame 11, and a first cord 21 mounted on the eyelet 20, the weaving device 10 comprising; a module 25 releasably borne by the frame 11 and operable to selectively transmit a motive force to the eyelet 20; a second cord 42 mounted on the module 25; and a coupling 90 having a first and second member 92, 94 releasably fastened together, and wherein the first member 92 is operably engaged by the first cord 21, and the second member 94 is operably engaged by the second cord 42, and wherein the coupling 90 coacts with the first and second cords 21, 42 to transmit the motive force from the module 25 to the eyelet 20 to effect movement of the eyelet 20 relative to the frame 11, and wherein the detachment of the first and second members 92, 94 facilitates removal and replacement of the module 25.

A still further aspect includes a weaving device 10 having a frame 11, a resilient member 15 mounted on the frame, an eyelet 20 mounted on the resilient member 15 and movable with respect to the frame 11, and a first cord 21 having a first end 22 which is fixedly mounted on the frame 11 and a second end 23 which is mounted on the eyelet 20 and movable therewith, the weaving device 10 comprising; a module 25 releasably borne by the frame 11; a griff bar 72 mounted on the module 25 and reciprocally movable along a path of travel in relation thereto; a latch 60 pivotally borne by the module 25; a solenoid 70 borne by the module 25 and disposed in coactive relation to the latch 60, and operable to influence the positional disposition of the latch 60 by the production of a magnetic field when energized; a hook 50 movably borne by the module 25 and selectively engageable by the latch 60 and griff bar 72, and which coacts with same so as to be selectively movable along the path of travel of the griff bar 72; a second cord 42 having a first and second ends 43, 44 which are connected to the module 25, and mount the hook 50 for movement responsive to movement of the griff bar 72; a coupling 90 having a first and second member 92, 94 which are releasably fastened together, and wherein the first member 92 has a sheave 116 rotatably mounted thereon which is operably engaged with the first cord 21 between the first and second ends thereof, and which coacts therewith to affect movement of the eyelet 20, and wherein the second member 94 has a sheave 118 rotatably mounted thereon and which is operably engaged with the second cord 42 between the first and second ends 43, 44 thereof, and wherein the first member 92 has a male fastening portion is 93, and the second member 94 has a complimentary female fastening portion 95 which receives the male fastening portion 93 in releasable interlocking relation therewith; and a tool 110 selectively engageable with the coupling 90 to detach the first and second members 92, 94.

A still further aspect of the present invention includes a coupling 90 and associated tool 110 for use with a weaving device 10 which has a frame 11, an eyelet 20 movably mounted on the frame 11, and a motor 84 which selectively produces a motive force which acts upon the eyelet, the coupling 90 and related tool 110 comprising: a first member 92 which is mounted in force transmitting relation relative to the eyelet 20, the first member 92 having a main body 96 with opposite first and second ends 98, 99, and wherein the main body 96 defines an internal cavity 115, and wherein an aperture 103 is formed in the first end 98 of the main body 96 and communicates with the cavity 115, a sheave 116 rotatably mounted in the cavity 115, and a pair of resiliently deflectable arms 100 disposed on the second end 99 of the main body 96, and wherein each of the deflectable arms 100 has a proximal end 112 which is made integral with the second end 99 of the main body, and an opposite distal end 113, and wherein the respective deflectable arms move along a given path of travel between a locked position and an unlocked position, and wherein a space 114 is defined between the respective deflectable arms 100, and the second end 99 of the main body; a second member 94 releasably coupled to the first member 92, and wherein the second member 94 has a main body 106 with opposite first and second ends 108, 109, and wherein the second end is disposed in force receiving relation relative to the motive force, and wherein the main body 94 defines a tool receiving aperture 107 formed in the main body 106 and is located intermediate of the first and second ends 108, 109 of the main body 106, and wherein a sheave 118 is rotatably mounted adjacent the second end of the main body, and wherein a locking member 104 is mounted on the second member 94, and wherein when the first and second members 92, 94 are releasably coupled together, the respective deflectable arms 100 are received in the second member 94 and are disposed in releasable interlocking relation relative to the locking member 104, and partially occlude the tool receiving aperture 107; and a tool 110 for mating receipt in the tool receiving aperture 107, the tool facilitating the engagement and disengagement of the first and second members 92, 94, and wherein the tool 110, when received in the tool receiving aperture 107, disengages the respective deflectable arms 100 from the locking member 104.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A weaving device having a frame and an eyelet movably mounted on the frame, the weaving device comprising;

a module releasably borne by the frame and operable to selectively transmit a motive force to the eyelet;

a coupling having a first and second member which are releasably coupled together in force receiving relation and relative to the module, and wherein the first member is mounted on the eyelet, and the second member is mounted on the module, and wherein the coupling transmits the motive force from the module to the eyelet to move the eyelet selectively relative to the frame, and wherein the coupling facilitates removal and replacement of the module.

2. A weaving device as claimed in claim 1, and wherein the first and second members each have complimentary portions made integral therewith and which engage each other to releasably couple the first and second members together.

3. A weaving device as claimed in claim 2, and wherein the first member has a male portion, and the second member has a complimentary female portion which receives the male portion in releasable coupling relation.

4. A weaving device as claimed in claim 3, wherein the male portion is defined by an elongated member having an enlarged end portion, and the female portion includes a complimentary locking member which releasably mates with the enlarged end portion.

5. A weaving device as claimed in claim 4, and wherein the enlarged end portion resiliently deflects when moved into engagement with the locking member to effect a snap-fit engagement of the enlarged end portion by the locking member.

6. A weaving device as claimed in claim 5, and further comprising a resilient member mounted on the frame, and wherein the eyelet is mounted on the resilient member, and the first member is mounted on the eyelet.

7. A weaving device as claimed in claim 6, and wherein the module further comprises:

a griff bar movably mounted on the module;

a hook mounted on the second member and which selectively coacts with the module, and wherein the griff bar selectively engages the hook and transmits the motive force to the hook.

8. A weaving device as claimed in claim 7, and wherein the module further comprises:

an actuator which is operable to transmit force to the griff bar to provide movement thereto.

9. A weaving device as claimed in claim 8, and wherein the module further comprises:

a latch which selectively engages the hook and retains the hook in a given position, and wherein engagement of the hook by the latch causes the hook to disengage the griff bar.

10. A weaving device as claimed in claim 9, and wherein the module further comprises:

a solenoid which produces a magnetic field when energized with electrical current, and which affects the selective engagement of the hook by the latch.

11. A weaving device as claimed in claim 10, and wherein production of the magnetic field by the solenoid substantially prevents the latch from retaining the hook.

12. A weaving device as claimed in claim 11, and further comprising a controller electrically connected to the solenoid and the actuator, and which selectively controls the flow of electrical current thereto.

13. A weaving device as claimed in claim 12, and wherein the second member has a main body which defines an aperture, and wherein a tool is selectively manually engageable with the coupling, and is received in mating relation in the aperture, and wherein the tool, once received in the aperture, coacts with the first member and facilitates uncoupling of the first and second members.

14. A weaving device as claimed in claim 13, and wherein the tool coacts with the coupling to releasably deflect the male portion so as to effect disengagement of the male and female portions.

15. A weaving device as claimed in claim 14 and further comprising a first sheave rotatably mounted on the first member and which coacts with a first cord, and wherein the first member is mounted in force transmitting relation to the eyelet by the first cord.

16. A weaving device as claimed in claim 15, and further comprising a second sheave rotatably mounted on the second member and which operably engages a second cord, and wherein the second cord is disposed in force transmitting relation relative to the hook by the second cord.

17. A weaving device having a frame, a resilient member mounted on the frame, an eyelet mounted to the resilient member and movable with respect to the frame, and a first cord mounted on the eyelet, the weaving device comprising;

a module releasably borne by the frame and operable to selectively transmit a motive force to the eyelet;

a second cord mounted on the module; and a coupling having a first and second member releasably fastened together, and wherein the first member is operably engaged by the first cord, and the second member is operably engaged by the second cord, and wherein the coupling coacts with the first and second cords to transmit the motive force from the module to the eyelet to effect movement of the eyelet relative to the frame, and wherein the detachment of the first and second members facilitates removal and replacement of the module.

18. A weaving device as claimed in claim 17, and wherein the first member has a male fastening portion made integral therewith, and the second member has a complimentary female fastening portion made integral therewith, and wherein the fastening portions of the first and second members releasably engage each other.

19. A weaving device as claimed in claim 18, and wherein the male fastening portion includes a resiliently deflectable arm, and wherein the female fastening portion includes a locking member which engages and retains the arm.

20. A weaving device as claimed in claim 19, wherein the first member has a main body, and wherein a pair of resiliently deflectable arms extend outwardly therefrom and define a space therebetween.

21. A weaving device as claimed in claim 20, wherein each of the deflectable arms has a distal end, and wherein each distal end is enlarged.

22. A weaving device as claimed in claim 21, wherein the first member defines a chamber which mounts a first rotatable sheave, and wherein the first cord engages the first sheave.

23. A weaving device as claimed in claim 22, wherein the second member has a main body with opposite first and second ends, and wherein a second sheave is mounted on the second end of the main body, and wherein the second cord engages the second sheave, and wherein the second member defines a chamber which receives the deflectable arms, and wherein a diverging engagement surface is mounted in the chamber and which is operable to deflect the deflectable arms and interlock therewith.

24. A weaving device as claimed in claim 23, wherein the main body of the second member defines an aperture, and wherein the deflectable arms, when engaged with the female portion, partially occlude the aperture.

25. A weaving device as claimed in claim 24, and wherein the deflectable arms deflect as they engage the diverging engagement surface defined by the locking member, and wherein, when fully engaged with the locking member the deflectable arms return to a substantially undeflected condition.

26. A weaving device as claimed in claim 25, and wherein the deflectable arms are substantially coplanar with the first sheave mounted on the first member.

27. A weaving device as claimed in claim 26, and wherein the first and second members, when coupled, position the deflectable arms in substantially coplanar relation relative to the second sheave which is mounted on the second member.

28. A weaving device as claimed in claim 27, and wherein the first cord has a first end which is mounted on the eyelet, and a second end which is mounted on the frame, and wherein the first sheave operably engages the first cord between the first and second ends thereof, and coacts therewith to affect movement of the eyelet.

29. A weaving device as claimed in claim 28, and wherein the second cord has a first end which is fixedly mounted on the module, and a second end which is movably influenced by the motive force, and wherein the second sheave operably engages the second cord between the first and second ends thereof, and coacts therewith to effect movement of the eyelets.

30. A weaving device as claimed in claim 29, and wherein the module comprises:

a reciprocally movable griff bar mounted on the module;

a hook mounted on the second cord and which coacts with the module, and wherein the griff bar selectively engages the hook and imparts movement thereto.

31. A weaving device as claimed in claim 30, and wherein the module further comprises:

a latch pivotally mounted on the module, and which selectively engages the hook, and wherein the hook when engaged by the latch disengages from the griff bar.

32. A weaving device as claimed in claim 31, and wherein the module further comprises:

a solenoid releasably mounted on the module, and which influences the movement of the latch relative to the hook.

33. A weaving device as claimed in claim 32, and wherein the module further comprises:

an actuator coupled in force transmitting relation to the griff bar, and which produces selective movement in same.

34. A weaving device as claimed in claim 33, and further comprising:

a controller electrically coupled to the solenoid and actuator, and operable to selectively supply electrical current thereto.

35. A weaving device as claimed in claim 34, and further comprising:

a tool received in the aperture, and which coacts with the deflectable arms to deflect and release the deflectable arms from the locking member, and to facilitate detachment of the first and second members.

36. A weaving device having a frame, a resilient member mounted on the frame, an eyelet mounted on the resilient member and movable with respect to the frame, and a first cord having a first end which is fixedly mounted on the frame and a second end which is mounted on the eyelet and movable therewith, the weaving device comprising;

a module releasably borne by the frame;

a griff bar mounted on the module and reciprocally movable along a path of travel in relation thereto;

a latch pivotally borne by the module;

a solenoid borne by the module and disposed in coactive relation to the latch, and operable to influence the positional disposition of the latch by the production of a magnetic field when energized;

a hook movably borne by the module and selectively engageable by the latch and griff bar, and which coacts with same so as to be selectively movable along the path of travel of the griff bar;

a second cord having a first and second ends which are connected to the module, and mount the hook for movement responsive to movement of the griff bar;

a coupling having a first and second member which are releasably fastened together, and wherein the first member has a sheave rotatably mounted thereon which is operably engaged with the first cord between the first and second ends thereof, and which coacts therewith to affect movement of the eyelet, and wherein the second member has a sheave rotatably mounted thereon and which is operably engaged with the second cord between the first and second ends thereof, and wherein the first member has a male fastening portion, and the second member has a complimentary female fastening portion which receives the male fastening portion in releasable interlocking relation therewith; and a tool selectively engageable with the coupling to detach the first and second members.

37. A weaving device as claimed in claim 36, and wherein the male portion includes two substantially equal length, resiliently deflectable prongs, and wherein each prong is disposed in substantially parallel, spaced, juxtaposed relation relative to the other, and wherein each prong has a distal end and a laterally disposed inwardly facing and hook-shaped terminus, and wherein each hook-shaped terminus faces the other, and a gap is defined therebetween.

38. A weaving device as claimed in claim 37, and wherein the female portion includes a locking member having opposite diverging sides, and wherein the respective prongs resiliently deflect outwardly away from one another to enlarge the gap as the prongs forcefully engage the diverging sides of the locking member, and wherein continued movement of the prongs against the diverging sides of the locking member causes the terminus of each hook to proceed past the locking member and effect a snap-fit with the locking member.

39. A weaving device as claimed in claim 38, and wherein the second member defines an aperture therein, and wherein each terminus partially occludes the aperture, and wherein the tool is shaped so as to be inserted through the aperture and to engage each exposed terminus and resiliently deflect the same outwardly with respect to the locking member to cause the release of the first member from the second member.

40. A coupling and associated tool for use with a weaving device which has a frame, an eyelet movably mounted on the frame, and a motor which selectively produces a motive force which acts upon the eyelet, the coupling and related tool comprising:

a first member which is mounted in force transmitting relation relative to the eyelet, the first member having a main body with opposite first and second ends, and wherein the main body defines an internal cavity, and wherein an aperture is formed in the first end of the main body and communicates with the cavity, a sheave rotatably mounted in the cavity, and a pair of resiliently deflectable arms disposed on the second end of the main body, and wherein each of the deflectable arms has a proximal end which is made integral with the second end of the main body, and an opposite distal end, and wherein the respective deflectable arms move along a path of travel between a locked position and an unlocked position, and wherein a space is defined between the respective deflectable arms, and the second end of the main body;

second member releasably coupled to the first member, and wherein the second member has a main body with opposite first and second ends, and wherein the second end is disposed in force receiving relation relative to the motive force, and wherein the main body defines a tool receiving aperture formed in the main body and is located intermediate of the first and second ends of the main body, and wherein a sheave is rotatably mounted adjacent the second end of the main body, and wherein a locking member is mounted on the second member, and wherein when the first and second members are releasably coupled together, the respective deflectable arms are received in the second member and are disposed in releasable interlocking relation relative to the locking member, and partially occlude the tool receiving aperture; and a tool for mating receipt in the tool receiving aperture, the tool facilitating the engagement and disengagement of the first and second members, and wherein the tool, when received in the tool receiving aperture, disengages the respective deflectable arms from the locking member.

41. A coupling and associated tool as claimed in claim 40, and wherein, during operation of the respective weaving device, the coupling reciprocally moves along a path of travel, and wherein a line of reference is defined by the coupling and wherein the line of reference is substantially coaxial with the path of travel and extends between the first end of the first member and the second end of the second member, and wherein the deflectable arms are substantially parallel to, and laterally offset from, the line of reference.

42. A coupling and associated tool as claimed in claim 41, and wherein the distal end of each deflectable arm has an engagement surface thereon which is obliquely oriented relative to the line of reference, and wherein the engagement surfaces coact with the locking member to releasably interlock therewith when the locking member is disposed within the space defined between the respective arms, and the deflectable arms are in the locked position.

43. A coupling and associated tool as claimed in claim 42, and wherein the sheave mounted on the first member has an axis of rotation which is oriented along the line of reference.

44. A coupling and associated tool as claimed in claim 43, and wherein the distal end of each deflectable arm hooks inwardly, one toward the other.

45. A coupling and associated tool as claimed in claim 44, and wherein the respective deflectable arms are substantially equal length.

46. A coupling and associated tool as claimed in claim 45, and wherein the locking member has a proximal end which is adjacent to the first end of the second member, and the distal end which is adjacent to the tool receiving aperture, and wherein the proximal end of the locking member has a divergent engagement surface formed thereon which coacts with the deflectable arms to deflect same to the unlocked position during the engagement of the first member with the second member.

47. A coupling and associated tool as claimed in claim 46, and wherein the sheave mounted on the second member has an axis of rotation which is oriented along the line of reference.

48. A coupling and associated tool as claimed in claim 47, and wherein the locking member lies along the line of reference and is substantially symmetrical about the line of reference.

49. A coupling and associated tool as claimed in claim 48, and wherein, during mating receipt of the tool in the tool receiving aperture, the tool displaces the deflectable arms from the aperture and moves same to the unlocked position, allowing release of the first and second members.

50. A coupling and associated tool as claimed in claim 49, wherein the engagement surface diverges as it extends from the first end of the second member in the direction of the tool receiving aperture.

51. A coupling and associated tool as claimed in claim 50, wherein the tool has a pair of opposed flutes which individually engage the respective deflectable arms which partially occlude the tool receiving aperture.

52. A coupling and associated tool as claimed in claim 51, wherein the tool has an elongated main body with a proximal and distal end, and wherein the flutes extend along the main body, and wherein the distal end has a reduced cross-sectional dimension relative to the remaining portion of the main body.

* * * * *